US005335833A

United States Patent [19]

Rancoule

[11] Patent Number: 5,335,833

[45] Date of Patent: Aug. 9, 1994

[54] ZIRCONIA GRAPHITE SLIDE GATE PLATES

[75] Inventor: Gilbert I. Rancoule, Beaver County, Pa.

[73] Assignee: Vesuvius Crucible Company, Pittsburgh, Pa.

[21] Appl. No.: 944,432

[22] Filed: Sep. 14, 1992

[51] Int. Cl.[5] ..... B22D 41/08

[52] U.S. Cl. ..... 222/600; 501/104

[58] Field of Search ..... 222/600; 266/236; 501/103, 105, 104

[56] References Cited

U.S. PATENT DOCUMENTS

| | | | |
|---|---|---|---|
| 5,11,673 | 4/1991 | Kriechbaum et al. | 501/103 |
| 3,518,100 | 6/1970 | Whittemore | 501/104 |
| 4,386,765 | 6/1983 | Roberts et al. | 266/236 |
| 4,415,103 | 11/1983 | Shapland et al. | 222/600 |
| 4,720,083 | 1/1988 | Zverina et al. | 222/600 |
| 4,835,123 | 5/1989 | Bush et al. | 501/104 |
| 4,847,222 | 7/1989 | Knauss et al. | 501/104 |
| 4,849,383 | 7/1989 | Tanemura et al. | 501/104 |
| 4,858,794 | 8/1989 | Sugiura et al. | 501/104 |
| 4,917,276 | 4/1990 | Shikano et al. | 222/600 |
| 4,989,762 | 2/1991 | Ando et al. | 501/104 |

FOREIGN PATENT DOCUMENTS

| | | | |
|---|---|---|---|
| 0232983 | 12/1984 | Japan | 222/600 |

*Primary Examiner*—Scott Kastler

*Attorney, Agent, or Firm*—Webb Ziesenheim Bruening Logsdon Orkin & Hanson

[57] ABSTRACT

A corrosion and erosion resistant, high strength refractory composition suitable for use as a slide gate valve plate or insert for such plates. The mix for the composition comprises in weight per cent about 87–90 high purity, partially stabilized zirconia; 4–5 silicon metal; 3–12 alumina, 3–5 graphite and 4–7 carbonaceous binder. The mix is pressed to a desired shape and fired in a reducing atmosphere at a temperature in excess of 1000° C. to produce a carbon bonded shape. High purity magnesia and high purity yttria, partially stabilized zirconia materials are employed in the mix to obtain superior hot strength properties.

10 Claims, 2 Drawing Sheets

ZIRCONIA GRAPHITE SLIDE GATE PLATES

BACKGROUND OF THE INVENTION

The present invention relates generally to refractory compositions useful in metallurgical applications and, more particularly, to refractory materials which are resistant to the erosive and corrosive effects of molten steel treated with calcium.

Heretofore, it has been common practice to employ alumina graphite refractory compositions in the sliding gate valves which control the flow of molten steel from a ladle to a tundish and from the tundish to a continuous casting mold or molds. Sliding gate valves are well-known in the art as exemplified by U.S. Pat. No. 4,415,103 to Shapland et al.

Development of more aggressive grades of steel resulting from special alloy additions or chemical ladle treatments, in particular, calcium deoxidation practices, have caused markedly increased chemical attack of the refractory components in the slide gate valve contacting the molten metal. In order to resist such erosive and corrosive attack, it has been proposed to use oxide bonded zirconia material. In addition, a zirconia carbon material is disclosed in U.S. Pat. No. 4,917,276 to Shikano et al. The '276 patent teaches a refractory composition for a sliding gate nozzle formed of a zirconia base refractory material composed of more than 53% by weight of partially stabilized zirconia having less than 10 mesh grain size and up to 30% by weight unstabilized zirconia. The material also contains 1- 7% by weight of metallic silicon powder having less than 100 mesh grain size, and 3 to 10% by weight carbon powder having less than 100 mesh grain size. The '276 patent further discloses that the zirconia base material should contain no alumina or silica but fails to attach any significance to the type of stabilized zirconia to be employed.

Typically, a sliding surface for a refractory plate should possess a hot strength up to 800 psi (56 $Kg/cm^2$) and a cold strength up to 2000 psi (140 $Kg/cm^2$) in order to maintain the necessary sliding integrity during service. It has been found that commonly used lime or calcia stabilized zirconia, while having outstanding cold strength properties, exhibits a dramatic drop in hot strength physical properties. Lime stabilized zirconia graphite material exhibits hot strength properties on the order of 150 to 400 psi which is not suitable for long term service as a slide gate plate. It is theorized that the impurities present in the lime stabilized zirconia migrate to the grain boundaries where they react to form a low temperature glassy phase which is incapable of resisting the higher temperatures.

The present invention overcomes the problems encountered in the prior art and provides a refractory composition for use in slide gate plates and inserts therefore which exhibit outstanding erosion and corrosion resistance to chemically aggressive steels while also possessing superior hot and cold physical properties.

SUMMARY OF THE INVENTION

Briefly, the present invention is directed to a refractory composition for use in a slide gate plate or insert for a slide gate plate, formed from a mixture consisting of, in weight %, about: 87–90 high purity, partially stabilized zirconia; 4–5 silicon metal (−200 mesh); 3–12 alumina (−325 mesh); 3–6 graphite (−200 mesh flakes); and 4–7 phenolic resin and furfural. Small amounts of boron carbide powder may also be added to improve oxidation resistance. Silica as a containment in the raw materials is controlled to a strict minimum (less than 0.01%) and, if possible, silica is completely absent from the mix.

The constituents are thoroughly mixed and hydraulically or isostatically pressed into the desired shape. The pressed shape is then fired in a reducing atmosphere at a temperature in excess of 1000° C. to produce a carbon bonded refractory shape of superior properties. The fired shapes are preferably impregnated with a carbonaceous material such as tar or resin to reduce the open porosity so as to prevent liquid metal infiltration and also to act as a lubricant between the sliding plates.

While the use of high purity zirconia stabilizer sources such as magnesia and yttria is preferred, it is also contemplated according to the present invention to employ a mixture of the lower purity calcia stabilized zirconia with the higher purity yttria and/or magnesia stabilized zirconia, along with a 3–12% by weight addition of alumina.

The alumina constituent develops a higher cold strength in the fired shape which permits abrasion and machining of the finished shape without cracking or spalling. The alumina also increases hot strength by the creation of intermediate crystalline phases with the impurities migrating from the zirconia material, such as silica and calcia which would otherwise form low melting glassy phases at the grain boundaries to the detriment of hot strength. Thermal shock resistance is also improved relative to the prior art composition.

DESCRIPTION OF THE PREFERRED EMBODIMENTS

Figure 1:
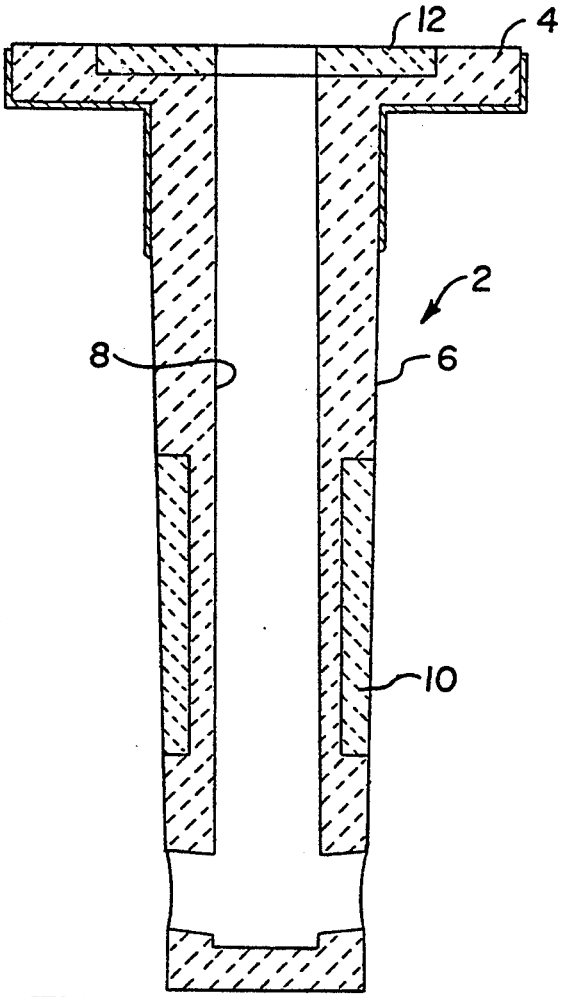
FIG. 1 is a cross-sectional side elevation view of a lower plate and integral pouring nozzle for use on a tundish sliding gate valve having an insert plate made according to the present invention.

Referring to the drawings, FIG. 1 depicts an integral lower plate and pouring tube, generally designated by reference numeral 2, for use as a lower plate in a sliding gate valve (not shown) for controlling molten steel flow from a tundish. The isostatically pressed member 2 comprises a plate portion 4 with an integral, co-pressed tube portion 6 having an axial bore 8 passing therethrough for teeming steel. The tube portion 6 may also have a co-pressed slagline sleeve 10 of an erosion resistant material therearound. Typically, the plate portion 4 and tube 6 may be formed of an alumina graphite refractory composition. The conventional slagline sleeve 10 may be formed of a zirconia graphite composition. An insert or full sliding surface 12 formed of a zirconia graphite composition according to the present invention is provided along an upper surface of the plate portion 4 surrounding the bore 8. The composition of insert 12 will be explained in greater detail hereinafter. The insert 12 may be isostatically co-pressed and fired with the member 2 or it may be pressed and fired separately and cemented into place. Firing is conducted in a reducing atmosphere to protect the carbon from oxidizing at temperatures of about 1000° C. (1832° F.) to about 1400° C. (2552° F.) to develop the carbon bond system prior to impregnation by a carbonaceous material.

Pressed and fired refractory shapes made according to the present invention are preferably impregnated with a liquid carbonaceous material such as tar (pitch) or resin. The carbonaceous material fills the pores of the fired refractory shape and protects the aluminum carbide and magnesia constituents from hydration. The carbon impregnation also reduces the apparent porosity which serves to further protect the refractory oxide from corrosive attack by the molten steel which otherwise occurs if the steel is permitted to infiltrate the pores of the refractory.

Generally, flat shapes, such as hydraulically pressed slide gate plates and plate inserts are tar impregnated, while more complicated isopressed and fired shapes are resin impregnated. Pieces to be impregnated are placed into a vessel and evacuated to approximately 0.99 bars. The vacuum is maintained at this level between 15 minutes and 1 hour. This ensures that entrapped air within the internal pores of the piece is removed. At this point, liquid resin is introduced into the vessel. The required viscosity of the impregnant is dependant on the pore size of the piece. A piece with finely distributed porosity requires low viscosity impregnant to ensure adequate impregnation. The viscosity range is typically between 10–100 centipoise. Higher viscosity resins can be used if thinned with appropriate solvents. Once the impregnant has been introduced to the vessel, a pressure between 1.5 and 7 bars is typically applied to force the resin into the porosity. This completes the impregnation process. An impregnated piece is then cured to 200°–250° C. to drive off low temperature volatiles. The cured resin can be carbonized to give fixed carbon by heating to 950° C. in a reducing atmosphere.

Figure 2:
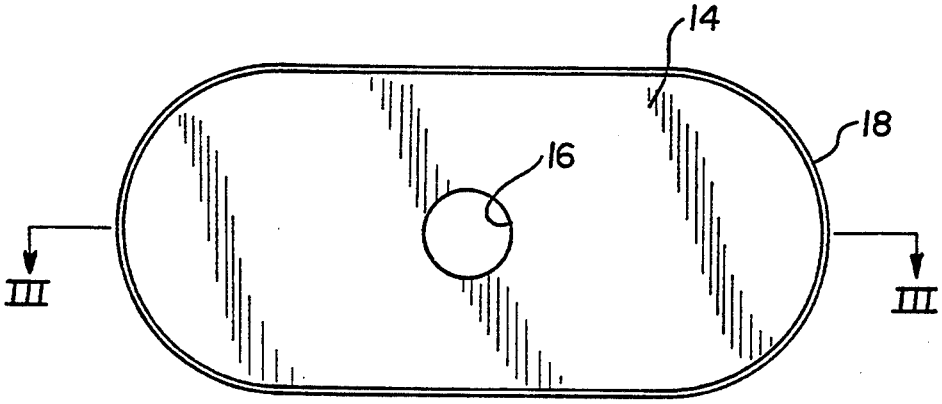
FIG. 2 is a plan view of a slide gate plate made according to the present invention.
Figure 3:
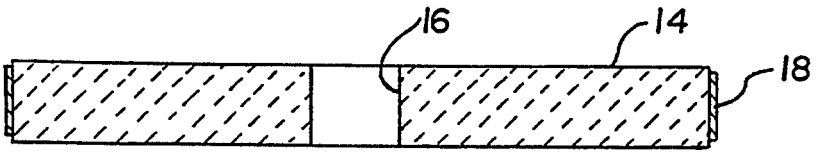
FIG. 3 is a cross-sectional side view of the plate of FIG. 2 taken along line III—III.

FIGS. 2 and 3 show a flat slide gate plate 14 useful as a component in a sliding gate valve. The plate 14 is formed by hydraulically pressing a powder mixture comprising the zirconia graphite composition of the present invention which is subsequently fired as previously described. The slide gate plate 14 has a bore 16 formed therein to permit the passage of molten steel therethrough. The plate 14 also may have a steel band 18 positioned around its periphery as is customary in plates of this type.

Figure 4:
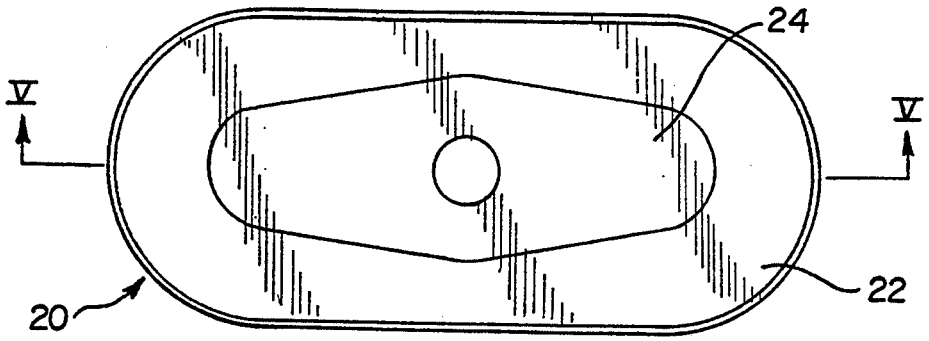
FIG. 4 is a top plan view of a lower slide gate plate suitable for use on a ladle and having an insert made according to the present invention.
Figure 5:
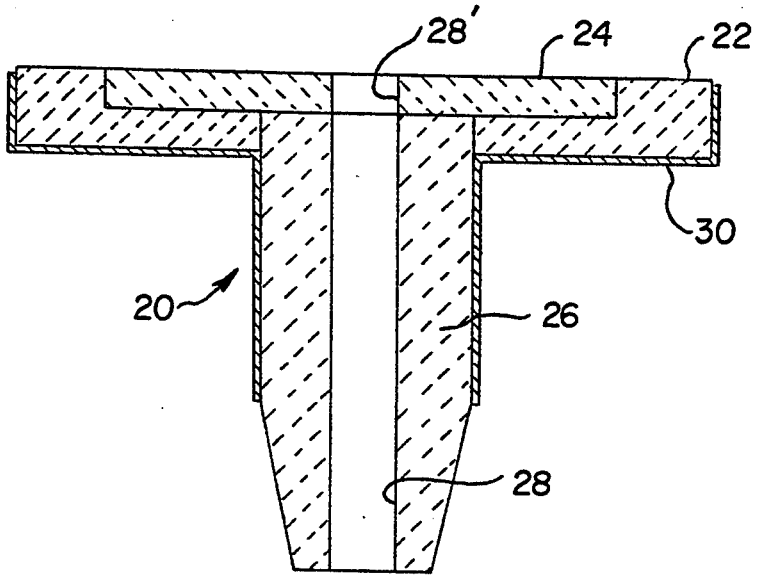
FIG. 5 is a cross-sectional side view of the lower plate and a collector nozzle taken along line V—V of FIG. 4.

FIGS. 4 and 5 depict an assembled lower plate and nozzle member 20 for use on a ladle type sliding gate valve. The member 20 includes a plate portion 22 with an insert 24 of a zirconia graphite composition of the invention hydraulically co-pressed or cemented therein. The nozzle portion 26 has a bore 28 axially aligned with bore 28' formed in the insert 24 for the passage of steel therethrough. A steel can 30 surrounds the plate and nozzle portions in a conventional manner. The plate member 22 may be formed of a castable refractory composition while the tube portion 26 is formed of a pressed and unfired refractory (carbon bonded or oxide bonded) or of a pressed and fired refractory metal oxide graphite refractory material such as a conventional alumina graphite.

Figure 6:
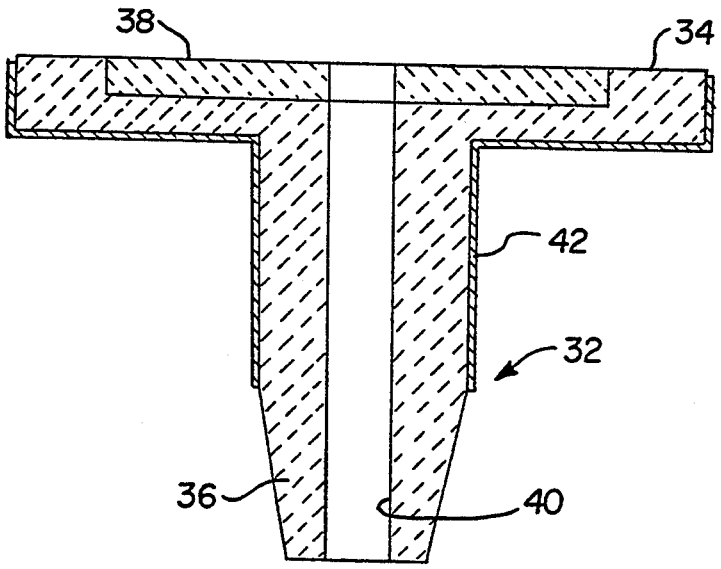
FIG. 6 is a cross-sectional side view of a lower plate and collector nozzle similar to FIG. 5 wherein the plate, insert and nozzle are co-pressed.

The integral lower plate and nozzle member 32 shown in FIG. 6 is similar to member 20 and is also suitable for use in a ladle sliding gate valve. Member 32 consists of co-pressed plate and nozzle portions, 34 and 36, respectively. An insert 38 of a zirconia graphite material according to the invention is co-pressed and fired with the plate and nozzle portions. An axial bore 40 extends through the insert 38 and nozzle portion 36 for the teeming of steel therethrough. A steel can 42 encases the member 32 in a known manner. The member 32 is preferably impregnated with tar after firing in a manner well-known in the art. Hydraulic pressed pieces are tar impregnated after firing. Isostatically pressed and fired pieces of a complex shape are usually resin impregnated. Thus, previously described member 2 is resin impregnated, while flat plate shapes 14 and 20 are preferably tar impregnated after firing.

In order to demonstrate the superior properties exhibited by the zirconia graphite compositions of the invention, a number of sample mixes were prepared having compositions set forth in Table I. Cold strength and hot strength physical properties for each mix are reported in Table II.

TABLE I

| Mix # | $ZrO_2$ (wt %) | CaO | Stabilizer Compound MgO | $Y_2O_3$ | Graphite (wt %) | SiMetal (wt %) | Binder (wt %) | $Al_2O_3$ (wt %) |
|---|---|---|---|---|---|---|---|---|
| 48 | 83 | yes | no | no | 2 | 3 | 6 | 0 |
| 49 | 78 | yes | no | no | 3 | 4 | 6 | 10 |
| 50 | 82 | yes | no | no | 3 | 4 | 6.5 | 5 |
| 65 | 82 | yes | no | no | 3 | 4 | 5.75 | 5 |
| 36 | 75(1) | yes | no | yes | 3 | 3 | 5 | 8 |
| 37 | 80(2) | yes | no | yes | 2 | 3 | 5 | 10 |
| 60 | 87 | no | yes | no | 3 | 4 | 5.75 | 0 |
| 63 | 82 | no | yes | no | 3 | 4 | 5.75 | 5 |
| 53 | 78 | no | yes | no | 4 | 4 | 6.5 | 5 |
| 38 | 75 | no | yes | no | 3 | 4 | 6 | 10 |

(1) 40% Ca Stab. $ZrO_2$, 35% $Y_2O_3$ Stab. $ZrO_2$
(2) 40% Ca Stab. $ZrO_2$, 40% $Y_2O_3$ Stab. $ZrO_2$

TABLE II

| Mix # | Physical Properties Cold Strength (psi) | Hot Strength (psi) |
|---|---|---|
| 48 | 1000 | 403 |
| 49 | 1800 | 431 |
| 50 | 2100 | 360 |
| 65 | 2484 | 296 |
| 36 | 1650 | 550 |
| 37 | 1730 | 630 |
| 60 | 1495 | 508 |
| 63 | 2040 | 555 |

TABLE II-continued

| Mix # | Physical Properties Cold Strength (psi) | Hot Strength (psi) |
|---|---|---|
| 53 | 2300 | 732 |
| 38 | 1585 | 785 |

In the practice of the invention, it is important to employ high purity alumina in finely divided form, preferably less than −325 mesh particle size. The particle size distribution of the zirconia material is also important and preferably about 10% by weight of the zirconia is between 6–20 mesh size and about 90% by weight of the zirconia is less than −325 mesh. The use of alumina fines in addition to the fines of zirconia and resin binder component develops higher cold strength properties which is beneficial when machining the fired shapes. The alumina constituent also stabilizes hot properties by creating intermediate crystalline phases. The alumina combines with certain impurities, such as silica and calcia which may be present in the zirconia, and prevents the impurities from migrating to the grain boundaries and forming low temperature glassy phases which would otherwise impair the high temperature strength of the material.

The zirconia graphite compositions of the invention preferably contain 87–90% by weight of partially stabilized zirconia. The degree of stabilization in the zirconia should be at least 60% in order to develop the enhanced physical properties required in the fired shape for high temperature service. Use of fully stabilized zirconia is not preferred in the invention because of its higher thermal expansion properties. The type of stabilizing agent used to partially stabilize the zirconia is also very important with respect to the hot strength properties developed in the refractory shape. It is critical that a high purity stabilizing agent, such as magnesia or yttria, be used rather than the commonly used lime (calcia) stabilizing material in order to obtain enhanced physical properties in the carbon bonded refractory shape. The addition of alumina further enhances properties even when the less pure lime (calcia or CaO) stabilized zirconia is used.

The physical properties reported in Table II indicate that the lime stabilized zirconia graphite refractory of mix nos. 48, 49 and 50 showed an increase in cold strength as the alumina content was increased in the mix. A maximum cold strength of 2100 psi was obtained in the lime stabilized material at a 5 wt. % alumina concentration while a maximum hot strength of 431 psi was achieved at 10 wt. % alumina.

Mix nos. 60, 63, 53 and 38 were prepared using a high purity magnesia partially stabilized zirconia with increasing amounts of alumina therein as reported in Table I. Once again, the highest cold strength level, 2300 psi, was obtained in the magnesia stabilized zirconia material at a 5 wt. % alumina content (mix no. 53) and the highest hot strength, 785 psi, was realized at a 10 wt. % alumina concentration, (mix no. 38).

The effect of the purity of the stabilizing system, lime versus magnesia, without the benefit of alumina, is shown by comparing the physical properties of mix nos. 48 and 60. The cold strength for the magnesia stabilized material of mix no. 60 was about 50% higher while the hot strength was more than 25% greater than the lime stabilized material of mix no. 48, wherein neither mix contained any alumina.

Sample mix nos. 36 and 37 contained both lime stabilized and yttria stabilized zirconia, as well as 8 wt. % and 10 wt. % alumina, respectively. It is observed that the cold and hot strength levels obtained in mix nos. 36 and 37 are higher than those reported for mix nos. 49 and 50 which were similar in composition, except for the addition of the higher purity yttria stabilized zirconia in mix nos. 36 and 37. The higher purity stabilized zirconia provided by yttria and/or magnesia yields superior hot strength properties compared with the lime stabilized zirconia graphite material. Hot strength is one of the most important properties in a slide gate application, providing the level of abrasion resistance required for safe operation, particularly required in a molten steel throttling procedure.

The sample mixes clearly demonstrate that alumina has a dramatic effect on physical properties. In the lime stabilized zirconia graphite materials, a 5% alumina addition (mix no. 65) lowered the hot strength by over 26% compared with the material of mix no. 48 which contained no alumina. This result appears to be consistent with the disclosure of the above discussed U.S. Pat. No. 4,917,276 which teaches that alumina should not be present in the refractory.

The present invention, however, utilizes alumina to dramatically increase the hot strength and cold strength of partially stabilized zirconia graphite refractories by employing a high purity magnesia and/or yttria stabilizing system. It is also important to control the silica contamination in all raw materials to a strict minimum, preferably to a zero level, in order to develop the improved elevated temperature physical properties.

The data as reported in Tables I and II clearly demonstrate that alumina additions in the high purity magnesia stabilized zirconia graphite material increase the cold strength to a maximum at the 5% alumina level. Above the 5% alumina level, cold strength decreases. Hot strength, however, continues to increase in the magnesia stabilized zirconia graphite material as the alumina content is increased to 10%.

Pressed and fired shapes made from the compositions of the present invention possess superior hot strength. These shapes are particularly suitable for use as slide gate components depicted in FIGS. 1–6 for regulating the flow of molten steel from a ladle or tundish. The shapes could also be used in a furnace valve, such as, for example, the vertically oriented furnace slide gate valve disclosed in U.S. Pat. No. 4,474,362.

The carbon bond system and graphite constituent in the fired shapes of the invention provide excellent thermal shock resistance, on the order of an alumina graphite refractory. The composition of the invention, in addition, provides superior resistance to chemical and erosive attack of calcium treated steels which aggressively attack other conventional refractories.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A fired refractory shape for use in controlling the flow of molten metal, prepared from a mix consisting of in weight %:

75–86 partially stabilized zirconia,

4–5 silicon metal,

3–6 graphite,

4–7 carbonaceous binder,

3–12 alumina, and wherein the partially stabilized zirconia includes one or more members selected from the group consisting of magnesia stabilized zirconia and yttria stabilized zirconia.

2. A refractory shape according to claim 1 wherein the shape is an insert in a slide gate plate.

3. A refractory shape according to claim 1 wherein the shape is a slide gate plate.

4. A refractory shape according to claim 1 wherein the shape is an insert in a slide gate plate and nozzle assembly.

5. A refractory shape according to claim 1 wherein the mix contains magnesia stabilized zirconia and about 10% by weight alumina.

6. A refractory shape according to claim 1 wherein the partially stabilized zirconia is at least 60% stabilized.

7. A refractory shape according to claim 1 wherein the partially stabilized zirconia comprises a mixture of calcia stabilized zirconia and yttria stabilized zirconia.

8. A carbon bonded zirconia-graphite refractory shape suitable for use in a molten metal environment, formed from a mix comprising in per cent by weight:

82–90 high purity partially stabilized zirconia

4–5 silicon metal,

3–6 graphite,

4–7 carbonaceous binder, and wherein the partially stabilized zirconia includes one or more members selected from the group consisting of magnesia stabilized zirconia and yttria stabilized zirconia.

9. A refractory shape of claim 8 including up to 7 weight per cent alumina.

10. A fired refractory shape according to claim 1 wherein the mix consists essentially of in weight %:

75–82 high purity magnesia partially stabilized zirconia, 4 silicon metal,

3–4 graphite,

6–7 carbonaceous binder, and

5–10 high purity alumina.

* * * * *

UNITED STATES PATENT AND TRADEMARK OFFICE

CERTIFICATE OF CORRECTION

PATENT NO. : 5,335,833

DATED : August 9, 1994

INVENTOR(S) : Gilbert I. Rancoule

It is certified that error appears in the above-indentified patent and that said Letters Patent is hereby corrected as shown below:

Title page, item [56], under References Cited, U.S. PATENT DOCUMENTS, "5,11,673 4/1991 Kriechbaum et al. ... 501/103" should read --5,011,673 4/1991 Kriechbaum et al. ... 501/103--.

Signed and Sealed this

Eleventh Day of October, 1994

*Attest:*

Bruce Lehman

BRUCE LEHMAN

*Attesting Officer*

*Commissioner of Patents and Trademarks*